US006312278B1

(12) United States Patent
Prior

(10) Patent No.: US 6,312,278 B1
(45) Date of Patent: Nov. 6, 2001

(54) CABLE PAD FOR SECURING CABLE AND SUPPORTING EQUIPMENT

(75) Inventor: Nathan Prior, Cary, NC (US)

(73) Assignee: Prior Associates, Inc., Cary, NC (US)

( * ) Notice: Subject to any disclaimer, the term of this patent is extended or adjusted under 35 U.S.C. 154(b) by 34 days.

(21) Appl. No.: 09/611,283

(22) Filed: Jul. 6, 2000

(51) Int. Cl.[7] ..... H01R 13/62
(52) U.S. Cl. ..... 439/371; 439/719; 206/320
(58) Field of Search ..... 439/719, 371, 439/501; 206/576, 320; 361/683

(56) References Cited

U.S. PATENT DOCUMENTS

| | | | | |
|---|---|---|---|---|
| 3,136,408 | | 6/1964 | Rockmann | 206/1 |
| 4,101,089 | | 7/1978 | Culbertson et al. | 242/85.1 |
| 4,658,298 | * | 4/1987 | Takeda et al. | 206/320 |
| 4,944,694 | * | 7/1990 | Dorn | 439/501 |
| 5,018,052 | | 5/1991 | Ammon et al. | 361/428 |
| 5,105,338 | | 4/1992 | Held | 361/391 |
| 5,214,574 | | 5/1993 | Chang | 361/393 |
| 5,364,289 | * | 11/1994 | Noguchi et al. | 439/501 |
| 5,457,600 | | 10/1995 | Campbell et al. | 361/643 |
| 5,469,844 | | 11/1995 | Rogler | 128/630 |
| 5,596,479 | | 1/1997 | Campbell et al. | 361/643 |
| 5,600,098 | | 2/1997 | Kazaks | 174/135 |
| 5,638,955 | | 6/1997 | Calciano | 206/320 |
| 5,666,265 | | 9/1997 | Lutz et al. | 361/683 |
| 5,669,571 | | 9/1997 | Graybill | 242/378.1 |
| 5,779,366 | | 7/1998 | McKenzie, III et al. | 383/22 |
| 5,808,865 | | 9/1998 | Alves | 361/685 |
| 5,871,481 | | 2/1999 | Kannenberg et al. | 606/34 |
| 5,924,892 | * | 7/1999 | Ferracina | 439/501 |
| 5,971,148 | | 10/1999 | Jackson | 206/320 |
| 6,026,961 | | 2/2000 | McCarthy et al. | 206/576 |
| 6,026,962 | | 2/2000 | Witt et al. | 206/702 |
| 6,105,766 | * | 8/2000 | Chuang | 206/320 |
| 6,145,661 | * | 11/2000 | Jung | 206/320 |

* cited by examiner

*Primary Examiner*—Brian Sircus
*Assistant Examiner*—Hae Moon Hyeon
(74) *Attorney, Agent, or Firm*—Withrow & Terranova, PLLC

(57) ABSTRACT

The present invention is a cable pad for electronic equipment comprising a thin, planar base of sufficient size such that the equipment may be placed thereon and thereafter provide a peripheral margin. The peripheral margin has a plurality of securing elements to fasten corresponding retention elements to the base. The retention elements hold equipment cables upon the base.

17 Claims, 7 Drawing Sheets

CABLE PAD FOR SECURING CABLE AND SUPPORTING EQUIPMENT

FIELD OF THE INVENTION

This invention relates generally to retaining devices for electronic equipment and more specifically to cable retention devices to facilitate organization of the cables used to operate electronic equipment.

BACKGROUND OF THE INVENTION

Due to recent technological advances, the use of electronic equipment, such as personal and notebook computers, printers, and other similar electronic equipment has increased dramatically. Often, such electronic devices require a multitude of cable connections. For example, in a training environment, multiple portable computers and networking equipment are connected via cables. The physical space dedicated to such activity is often not well suited to the abundance of cables necessary to operate the equipment. These cables dangle from the connection ports of the individual devices and create several problems.

First, the cables may become twisted together, making disconnection for portability difficult and cumbersome. Second, the cables may merely dangle from their connection ports in a disorderly manner and such dangling cables are not aesthetically pleasing. Third, the cable connection ports are becoming larger in number, increasingly smaller, and more fragile. This increases the risk of damaging the cables, ports, or both. Although a preferred arrangement provides the portable equipment with a sufficiently secured station to avoid incidental strain on the connection ports, such an arrangement is not available. A user may be faced with a narrow surface or an over-crowded room. The potential for unwanted or mistaken disconnection of a cable increases. Further, the disorderly nature of the cables provides the potential hazard of tripping over a cable that dangles to the floor. Any solution to these problems requires sufficient portability so as not to hinder the portable nature of the equipment itself. In this regard, a desirable aspect of any cable-retaining device is the ability to be adjustable and flexible in any given environment. For example, one aspect to improve the adjustable nature of any retaining device is the ability to easily slide as a unit over the surface upon which it is placed, thus improving versatility, while maintaining cable organization and strain relief.

SUMMARY OF THE INVENTION

The present invention provides a solution to the above problems by providing for the cables of portable electrical devices to be arranged in an orderly manner and by alleviating unwanted strain imposed upon the connection ports. The orderly nature of the cables provides a more secure station and assists in preventing unwanted disconnection and unwanted stumbling over unsecured cables. Although cables may attach at different locations on the electronic device, the present invention is adaptable to collect the cables regardless of their attachment point.

In particular, the present invention relates to a cable pad for organizing the cables of electronic equipment, such as a notebook computer. The cable pad has a base of sufficient size and shape such that when the equipment is placed upon the base, a peripheral margin should remain. Along the peripheral margin, the present invention has one or more securing elements. Preferably, the securing elements are along the back and on the right and left side of the base.

The securing element is adapted to connect a retention element to the base. The retention element is adjustable to secure the cables to the base. The retention element may be any appropriate fastening device that is able to maintain cables upon the base. Further, the securing element is any appropriate means to secure at least one retention element to the base. In this specification therefore, the phrase "securing element" is used to include and describe any appropriate technique to secure the retention element to the base. Thus, the securing element may be an opening through which the retention element may be secured, a releasable fastener that mates with a corresponding fastener on the retention element, or a non-releasable fastener to affix the retention element to the base.

Preferably, the base is made of flexible material that is thin and substantially planar. The bottom of the base preferably may be formed with a low-friction surface. The top of the base preferably includes a high-friction surface to provide some surface retention of the equipment on the pad. The top surface of the base may include a mouse pad suitable for operation of a mouse, or the entire pad may be turned over to provide a mouse pad surface.

The present invention also relates to a method and, additionally, a kit for securing cable connections to cabled equipment. The method includes, among other things, placing the electronic equipment on a flexible pad, connecting the cables to the equipment, and securing the cables to the flexible pad. In this manner, the cables are sufficiently secured to the pad so as to organize the cables, preserve the cable connection, and reduce the risk of hazards associated with dangling and entangled cables. The kit includes the components necessary for organizing cables on the cable pad.

These and other aspects of the present invention as disclosed herein will become apparent to those skilled in the art after a reading of the following description of the preferred embodiments when considered with the drawings. The drawings are for the purpose of describing a preferred embodiment of the invention and are not intended to limit the present invention.

DETAILED DESCRIPTION OF THE INVENTION

Figure 1:
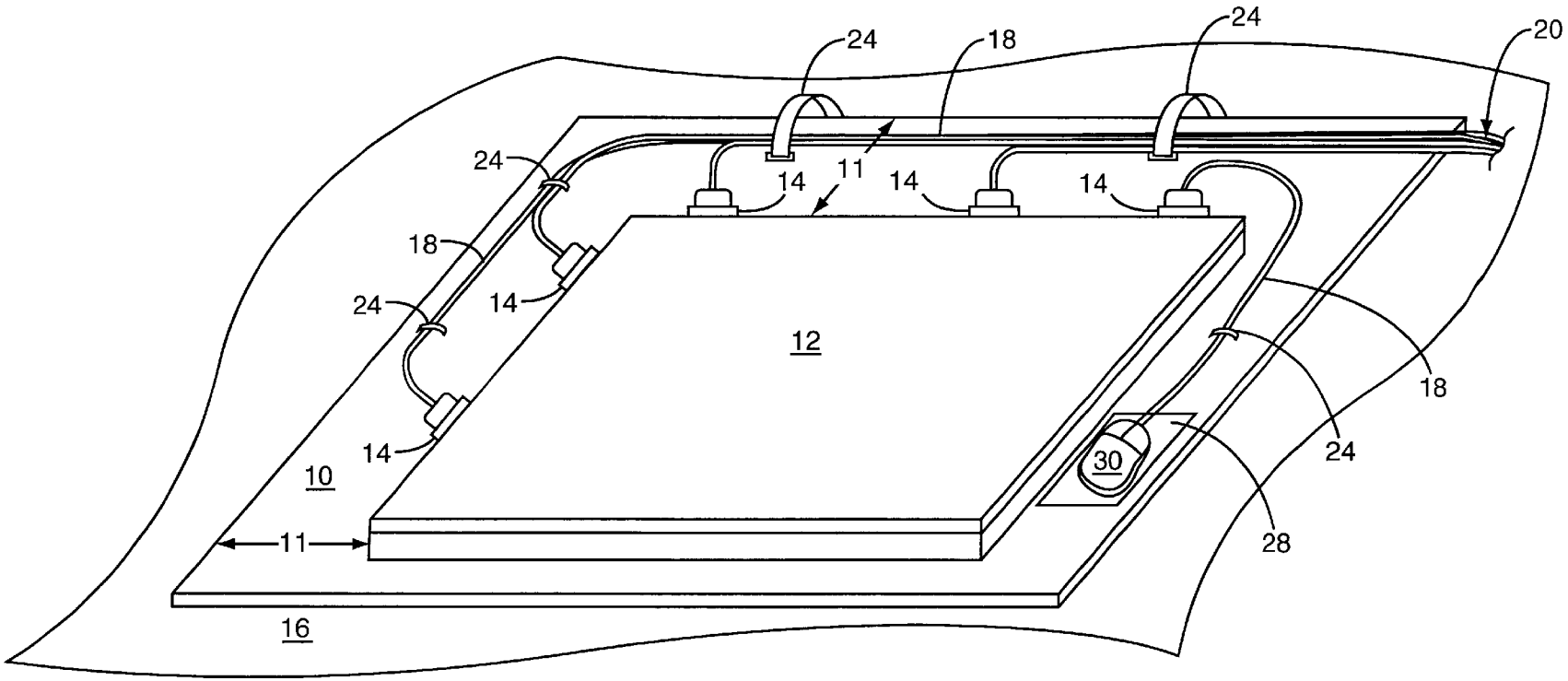
FIG. 1 is a top perspective view of one embodiment of the present invention illustrated with a notebook computer and connecting cables.

FIG. 1 illustrates the cable pad 10 of the present invention. As shown, the cable pad 10 preferably has a base of sufficient size and shape to accommodate the particular piece or pieces of electronic equipment to be used while leaving a peripheral margin 11 on the pad 10 for securing cables 18. For example, when used in conjunction with a notebook computer 12 having dimensions of about 8½"×11" the base pad may be approximately 12"×16", thereby creating a sufficient peripheral margin 11 for the attachment of retention elements 24 to the base 10 as described below in further detail.

The pad 10 should rest upon a supporting surface 16 such as a table or desk, or, if table surface space is limited, a flexible portion of the pad may hang over the side, while still providing cable attachment. FIG. 1 illustrates the cable pad 10 with a notebook computer 12. Although the present invention is described with a notebook computer, other electronic devices may also be used in association with the present invention such as projectors, printers, TV/VCR/DVD equipment, audio and stereo systems, medical and lab devices, shop equipment, or any other appropriate equipment or device.

In the example of FIG. 1, the notebook computer 12 has several connection ports 14, such as serial ports for a mouse or drawing tablet connection, multiple parallel ports for printer or external hard drive connections, a docking port, a network port for telephone or Ethernet connection, multiple USB ports for keyboard, printer, video camera, scanner, or other device, a PC Card slot, and also speaker, microphone, and power ports.

Each of these respective connection ports 14 allows a user to connect the notebook computer 12 via cables 18 to the respective peripheral device, network, or power source (not shown). As shown, the connection ports 14 on the computer 12 are located on different sides of the computer 12. Although not illustrated, other ports may be located on the front side of the computer 12 as well.

Without any retaining device, upon connection of the notebook computer 12 with the multitude of cables 18, the cables 18 extend from the computer 12 and off to different sides. The cables 18 dangle from the computer 12, perhaps across the support surface 16, and eventually down to the ground. Thus, the computer 12 would have various cables 18 extending outwardly from the computer 12 creating a disorganized workstation. The unkempt cables 18 present a potential for a thoroughfare accident such as tripping on the cables 18. The cables 18 may become loosened from their respective connection ports 14 creating the potential for loss of the cable link coupling. As discussed above, repetitive or forceful disconnection increases the risk for damage to the relatively fragile connection ports 14.

The present invention maintains the cables 18 in an orderly fashion to relieve the strain on the connection ports 14 and facilitate a safer thoroughfare environment. After connecting the cable 18 to the computer 12 through its connection port 14, the cable 18 is attached to the pad 10 and guided toward the other cables 18 such that the cables may be grouped together 20 and led together from the pad. Preferably, the cables attach about the periphery of the pad 10, within peripheral margin 11. The peripheral margin 11 need only be of a sufficient width to provide for appropriate retention elements 24. Thus, the peripheral margin 11 may vary depending upon the device 12 to be used. The grouped cables 20 may continue over the table and may be further organized by an adjacently placed cable pad 10 or may flow to the connection site. The number of cables 18 will vary depending upon the number of connections 14 that are necessary.

As shown in FIGS. 4A–4F, the base pad 10 has at least one securing element 21, 22, 23. As illustrated, the securing means is to be interpreted broadly to include any appropriate technique to secure at least one retention element 24 to the base 10. The retention element 24 may be any appropriate device to maintain the cables 18 upon the pad 10 preferably along the peripheral margin 11 of the pad 10. As will be understood by those skilled in the art, the number and size of the retention elements 24 may vary depending upon the electronic device 12 used in conjunction with the pad 10. Any appropriate retaining element 24 may be used. For example, and without limitation, retention element 24 may be a strap having hook and loop fasteners (FIGS. 4A and 4C), a strap having snap fasteners (FIG. 4D), a string (FIG. 4B), an elastic loop (FIG. 4E) or a rubber band, a clip, a belt, a cord, wired ribbon, a cable tie, a twist tie, tape, or any combination thereof. The considerations in choosing a retention element include its strength, portable nature, adjustable nature, and aesthetic appearance.

Figure 4B:
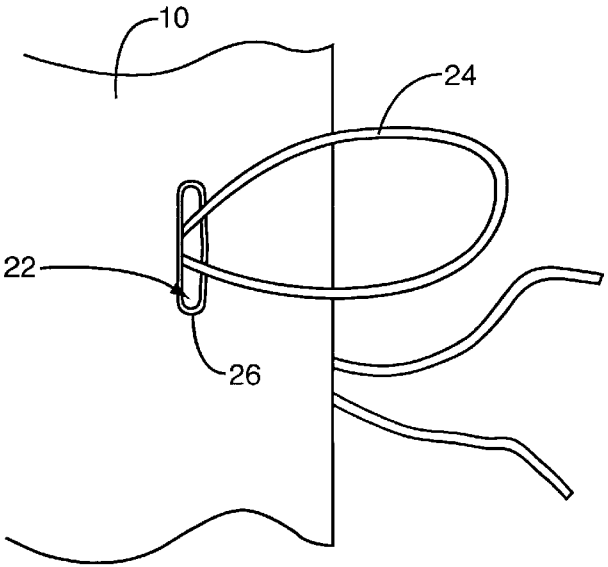
FIGS. 4A, 4B, 4C, 4D, 4E, and 4F are detailed views of alternative embodiments of the retaining element of the present invention.
Figure 4A:
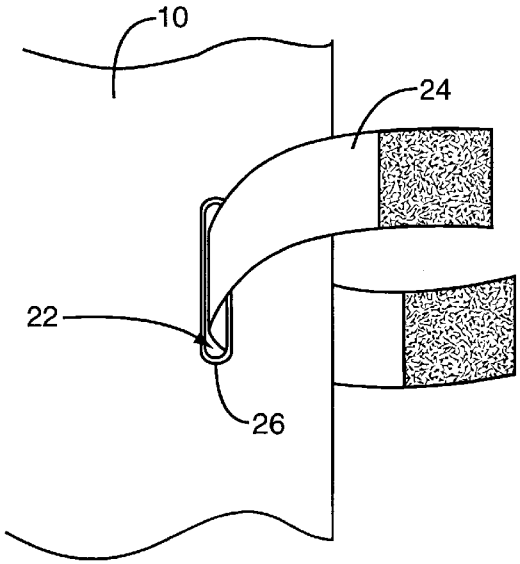
Figure 4D:
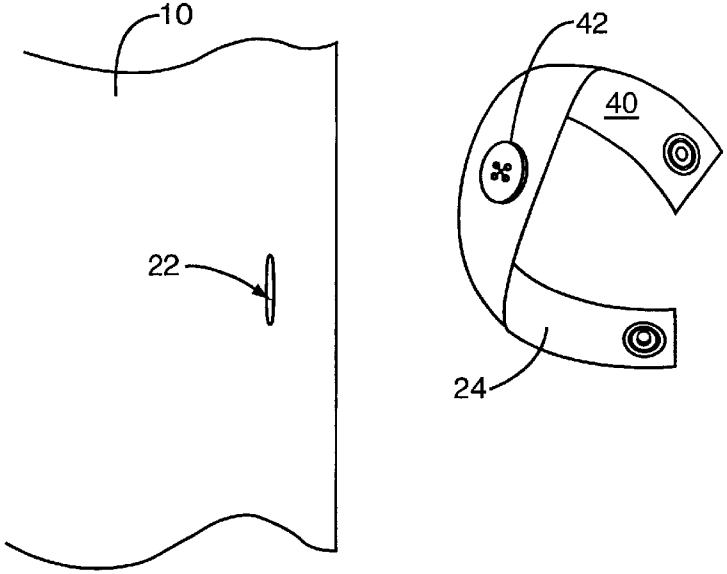

One embodiment of the pad 10 of the present invention has as the securing element at least one opening 22 for insertion of at least one retention element 24. The openings 22 allow for the passage of retention elements 24 for securing the cables 18 to the pad 10. Thus, as shown in FIGS. 4A and 4B, a retention element 24 may be threaded through opening 22 and thereafter secure the cable 18 to the pad 10. Alternatively, as illustrated in FIG. 4D, the retention element 24 may be an independent strap 40 having a button 42. The button 42 is insertable into an opening 22 for maintaining the strap 40 upon the pad 10. Thus, the opening 22 may vary in size, shape, and position depending upon the electronic equipment 12, the cabling required and the retention element 24 suited for retaining the cable 18.

Figure 2:
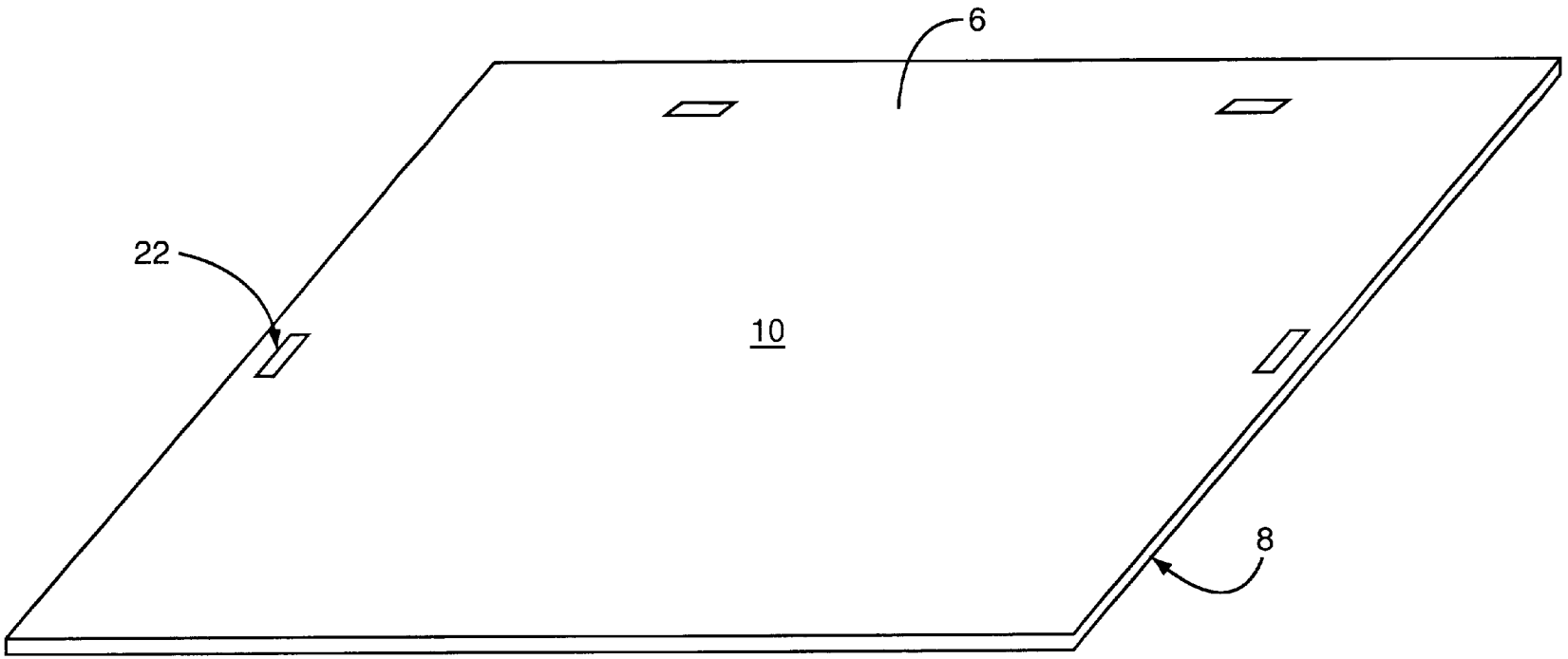
FIG. 2 is a top perspective view of one embodiment of the present invention.
Figure 3:
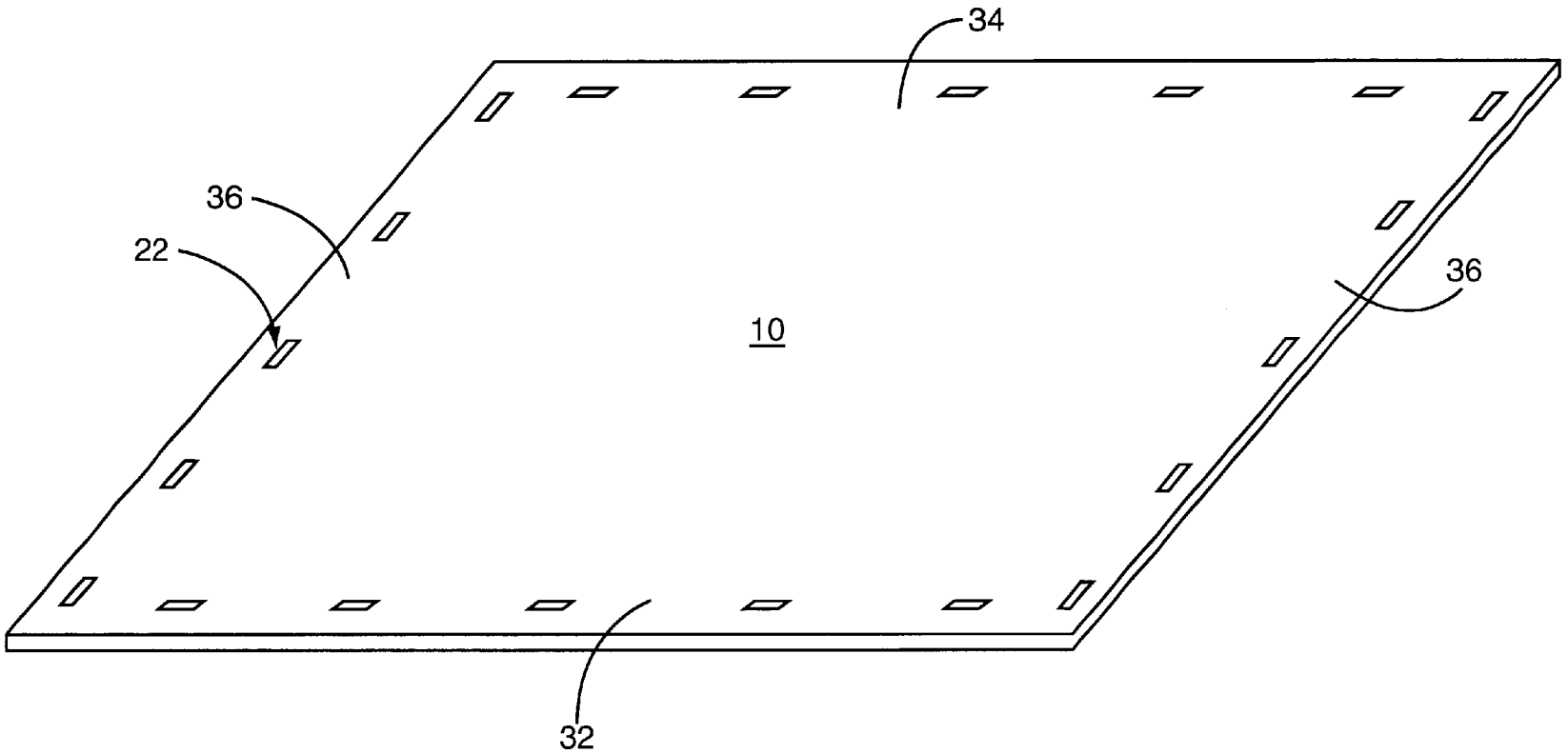
FIG. 3 is a top perspective view of one embodiment of the present invention, illustrating alternative openings.

As illustrated in FIGS. 2 and 3, the pad 10 may have relatively few or many openings 22. As shown in FIG. 4D, the opening 22 may be an eyelet, similar to a buttonhole, or as shown in FIG. 4A, may be relatively wide slit (⅜" to ½" wide) through which a retaining element 24 may be threaded. A combination of different openings 22 may be used for different sizes and types of retention elements 24. Preferably, the opening 22 is reinforced, such as in FIGS. 4A and 4B, such as with a plastic grommet 26. As shown in FIG. 3, preferably the pad 10 provides for cable connection(s) about the periphery of the equipment. Thus, openings 22 may be located on the front 32, back 34, and both sides 36 of the pad 10 in any appropriate configuration.

Figure 4C:
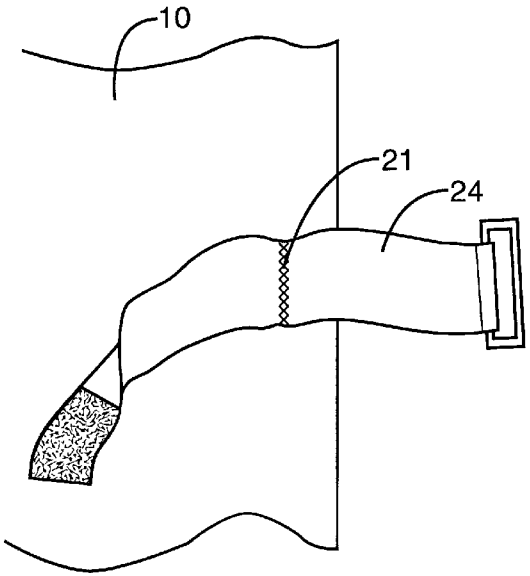
Figure 4E:
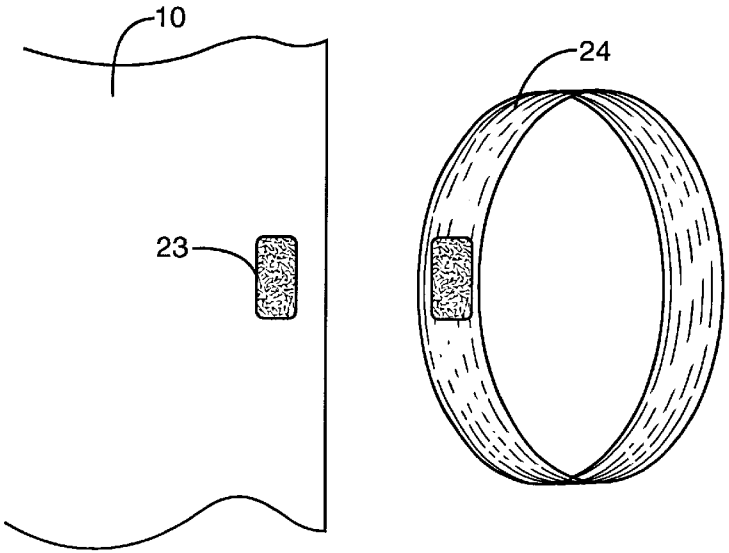
Figure 4F:
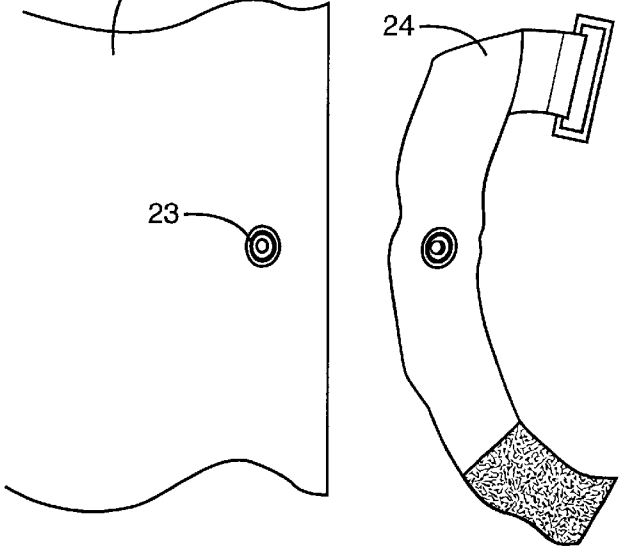

As an alternative embodiment of the pad of the present invention and as illustrated in FIGS. 4C and 4E, the retention element 24 may be affixed to the pad 10 through securing means such as gluing, sewing (FIG. 4C), hook and loop fastener (FIG. 4E), snap fastener (FIG. 4F), or any combination of appropriate fastening means. As an example to illustrate this further alternative embodiment of the retention element, FIG. 4C illustrates a strap having two ends. Such straps are known in the art, the first end has matingly engageable hook and loop fasteners on either side and the second end has a ring for receiving the first end to double back and fasten. The retention element 24 is affixed to the pad 10 and allows for the retention of cables within the retention element and corresponding retention of the cables to the pad 10. Thus, as illustrated in FIG. 4C, the securing element may not include openings 22 at all. Rather, the securing means may affix the retention element 24 non-releasably, as shown in FIG. 4C, or releasably, as shown in FIGS. 4E and 4F. As described above, the releasable securing element may be any appropriate fastening device, such as mating hook and loop fasteners, snap fasteners, or tape fasteners.

In this regard, the pad may have relatively few or many securing elements 21, 22, 23 about the periphery of the pad. Further, the securing elements 21, 22, 23 may be provided on the front 32, the rear 34, and on each side 36 of the pad 10.

Although the pad 10 may be made of any appropriate material, preferably the pad 10 is flexible. Thus, when the supporting surface 16 is relatively narrow, the pad 10 is able to flex about the supporting surface 16 while maintaining the cables 18 and electronic equipment 12 thereon and retaining the orderly nature of the workstation. Depending on the application, the bottom surface 8 of the pad 10 may be a smooth, low-friction material, such as laminated polyester, to allow the pad 10 to slide over the support surface 16, as shown in FIG. 2. Alternatively, the bottom surface 8 may be non-skid, higher friction material, such as rubber, to facilitate stability of the electronic equipment 12 upon the support surface 16. Preferably, the top surface 6 of the pad 10 is made of non-skid material to maintain some surface custody of the electronic equipment 12. Thus, as an example, the base pad 10 may be made of materials similar to a heretofore known mouse pad, but turned upside down to provide appropriate smooth and non-skid surfaces as described above.

Preferably, the pad 10 is relatively thin and substantially planar, for example, approximately 1/16" to 1/8" thick, and in most instances is approximately 1/16" thick. However, some applications may require a thicker and more rigid pad that is 1/8" to 1/2" or thicker.

As illustrated in FIG. 1, the pad 10 may include an area 28 appropriate for operation of a mouse 30. Thus, the area 28 may be made of any appropriate mouse pad material, such as laminated polyester. In this regard, additional openings 22, attachment points 23, and/or retention elements 24 may be used to organize the cable associated with the use of a mouse 30.

Figure 5:
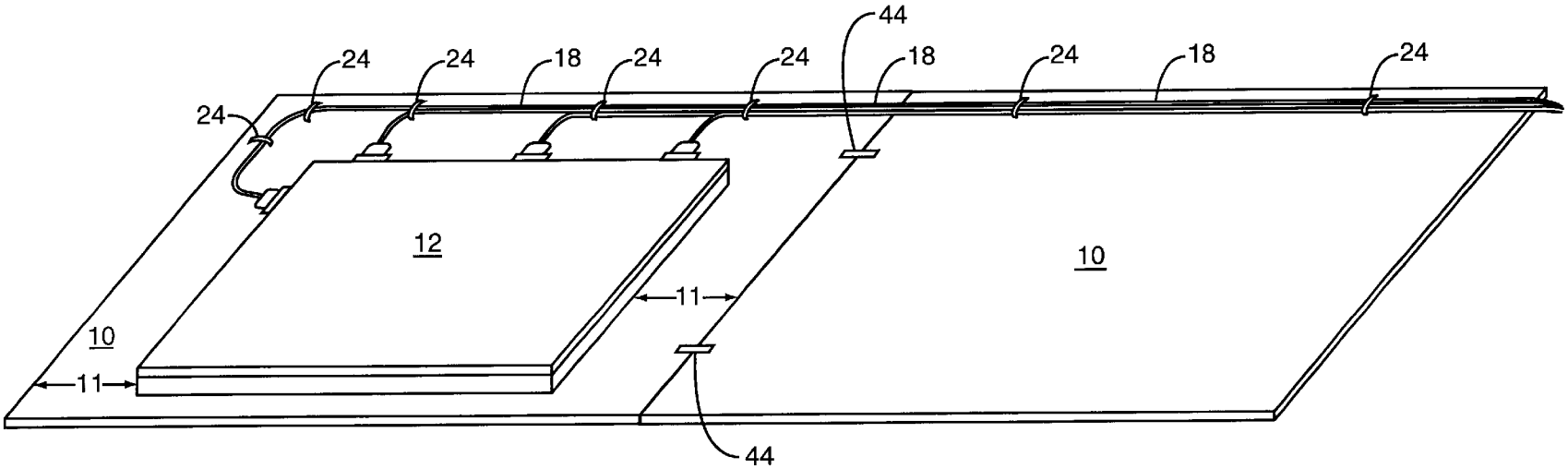
FIG. 5 is a top perspective view illustrating two cable pads of the present invention coupled together.

Additionally, the scope of the present invention should include the use of multiple cable pads as deemed necessary or desirable by the user. Multiple cable pads 10 may be utilized independently, or coupled together, as illustrated in FIG. 5, through use of a docking element 44 to provide a secure engagement. Docking element 44 may be the same as retention element 24 described herein or docking element 44 may be different.

Although specific embodiments of the present invention have been illustrated and described in detail, it is to be expressly understood that the invention is not limited thereto. The above detailed description of the embodiment is provided for example only and should not be construed as constituting any limitation of the invention. Modifications will be obvious to those skilled in the art, and all modifications that do not depart from the spirit of the invention are intended to be included within the scope of the appended claims.

What is claimed is:

1. A pad for supporting electronic equipment and securing related cables comprising a thin, planar base having:

a top surface sized to provide a peripheral margin extending outward from equipment placed upon the top surface of said base, said top surface including at least a portion within said peripheral margin constructed of a high friction material to reduce tendencies for equipment to slide on said top surface;

a bottom surface constructed of a low friction material to allow said pad to slide along a resting surface when cables of the equipment are pulled; and a plurality of securing elements within said peripheral margin, said securing elements for connecting to retention elements that hold equipment cables.

2. The pad of claim 1 wherein at least one of said securing elements is an opening on the top surface of said peripheral margin that extends through said base.

3. The pad of claim 1 wherein said base is thin and substantially planar.

4. The pad of claim 3 wherein said base is approximately 1/16" to 1/2" thick.

5. The pad of claim 2 wherein said opening is a slit of sufficient length and width to receive and hold a button attached to a retention element.

6. The pad of claim 1 wherein at least one said securing element is first fastener member on the top surface of said peripheral margin, said fastener for engaging a second fastener member on a retention element.

7. The pad of claim 6 wherein said first fastener member is a hook and loop member such that a corresponding second fastener member is releasably engageable with said first fastener member.

8. The pad of claim 6 wherein said first fastener member is a snap member such that a corresponding second fastener member is releasably engageable with said first fastener member.

9. The pad of claim 1 wherein at least one said securing element is releasably engageable with at least one retention element.

10. The pad of claim 1 further comprising a plurality of securing elements.

11. The pad of claim 1 wherein a portion of said top surface forms a mouse pad and comprises a material sufficient for operation of a mouse.

12. The pad of claim 1 further comprising coupling means along said peripheral margin for connecting said pad to another pad.

13. A pad and retention kit for supporting electronic equipment and securing related cables comprising:

a. a plurality of retention elements; and b. a thin, planar base having:

a top surface sized to provide a peripheral margin extending outward from equipment placed upon the top surface of said base, said top surface including at least a portion within said peripheral margin constructed of a high friction material to reduce tendencies for equipment to slide on said top surface;

a bottom surface constructed of a low friction material to allow said pad to slide along a resting surface when cables of the equipment are pulled; and a plurality of securing elements within said peripheral margin, each said securing element releasably engaging at least one said retention element for securing equipment cable to said base.

14. The kit of claim 13 wherein at least one of said securing elements is an opening on the top surface of said peripheral margin that extends through said base.

15. The kit of claim 13 wherein at least one said securing element is first fastener member on the top surface of said peripheral margin, said fastener for engaging a second fastener member on said retention element.

16. The kit of claim 13 wherein said top surface of said pad includes at least a portion within said peripheral margin that is constricted of a high friction material to reduce tendencies for equipment to slide on said top surface.

17. A pad for supporting electronic equipment and securing related cables comprising a thin, planar base having:

a top surface sized to provide a peripheral margin extending outward from equipment placed upon the top surface of said base, said top surface including at least a portion within said peripheral margin constructed of a high friction material to reduce tendencies for equipment to slide on said top surface;

a bottom surface constructed of a low friction material to allow said pad to slide along a resting surface when cables of the equipment are pulled; and a securing means along said peripheral margin, said securing means engaging a retention means for holding equipment cables.

* * * * *